US006277031B1

(12) United States Patent
Cheek et al.

(10) Patent No.: US 6,277,031 B1
(45) Date of Patent: Aug. 21, 2001

(54) TWO PLAYER GOLF CLUBS AND GAMES PLAYABLE WITH THE SAME

(75) Inventors: Charles Cheek, 23858 Via De Gema Linda, Murrieta, CA (US) 92562; Scott D. Cameron, Murrietta, CA (US)

(73) Assignee: Charles Cheek, Murrieta, CA (US)

( * ) Notice: Subject to any disclaimer, the term of this patent is extended or adjusted under 35 U.S.C. 154(b) by 0 days.

(21) Appl. No.: 09/440,891

(22) Filed: Nov. 16, 1999

Related U.S. Application Data

(60) Provisional application No. 60/108,892, filed on Nov. 17, 1998.

(51) Int. Cl.[7] ..... A63B 53/00

(52) U.S. Cl. ..... 473/294; 473/307; 473/313; 473/314; 473/340

(58) Field of Search ..... 473/294, 313, 473/340, 341, 307, 314

(56) References Cited

U.S. PATENT DOCUMENTS

| | | | | |
|---|---|---|---|---|
| D. 216,137 | | 11/1969 | Hemsoth . | |
| D. 349,143 | | 7/1994 | McKoon et al. . | |
| D. 377,674 | | 1/1997 | Schmidt et al. . | |
| 1,916,791 | * | 7/1933 | Hadden . | |
| 5,547,196 | | 8/1996 | Izett et al. | 473/242 |
| 5,647,806 | * | 7/1997 | McDevitt . | |
| 5,716,287 | | 2/1998 | Levocz et al. | 473/248 |

* cited by examiner

*Primary Examiner*—Jeanette Chapman
*Assistant Examiner*—Stephen L. Blaw
(74) *Attorney, Agent, or Firm*—John E. Wagner; Sam Bernardo

(57) ABSTRACT

A two-handled club for use by two persons simultaneously for striking a ball toward a target and a game for using same. The club is such that one handle or grip is oriented as a left-handed club, while the opposite handle is oriented as a right-handed club. A team comprising of two members, each grasps a club handle and simultaneously strikes the ball towards a target. A winner may be determined, for example, by the team requiring the fewest strokes to get to the target.

8 Claims, 4 Drawing Sheets

TWO PLAYER GOLF CLUBS AND GAMES PLAYABLE WITH THE SAME

REFERENCE TO RELATED APPLICATION

This non provisional application is based upon provisional Ser. No. 60/108,892 filed Nov. 17, 1998, and hereby claims the benefit of the filing date thereof.

BACKGROUND OF THE INVENTION

The history of the game of golf has been well documented and to this day it is properly characterized as a single player sport in which each player is totally responsible for his or her own play. Each player is the only one who touches his own ball or plays it. Except for scoring and conversation on the tees and greens, it is truly in individual sport. Any action, speech or other activity on a part of another player during the time that a player is in action, addressing the ball or swinging, is considered as discourteous, at best, or a violation of the rules and, in either case, totally unacceptable.

We have viewed the game of golf has being a basic platform which can be modified in the certain extent, to allow dual player interaction in striking the ball, so that dual player cooperation is essential for successful play. The net result is a series of two party team competitions in which the individual skills of the players are subordinated to their degree of cooperation and in their willingness to allow one player to act as a team captain during the act of striking the ball. As a side issue to this team captain status, we have designed a number of games in which team captain status may shift from one player to another for individual strokes, resulting in a highly entertaining competition between teams and with little or no opportunity for serious golf.

Fundamental to the games is the principle that the players of a team switch sides periodically, e.g., after each stroke, so that skills connected with either left or right handedness between competing teams tends to be equalized. This game in fact forces communication between team members.

Since the use of long irons and wood clubs involves major exertion and the need for precise control of the swing to gain the necessary distance, we have instead selected the golf putter as the club for dual player use and the step of putting to a hole or target practice cup by a team as the game play.

One advantage of our golf putting game is that vast experience or skill in putting is not requirement for success. Rather, the cooperation of each two person team members allows even novice or non-golf players to participate and have an enjoyable time. Even if they are teamed with an experienced golfer, the game contemplates that each player may act as team captain alternately so the novice or non-golf partner may be responsible for an excellent putt if their command capability is effective.

The basic club employed in this competition is a two-shaft putter, with the shafts each extending upward and outward from each other in the normal angle and length of conventional putters, but the shafts are located at opposite top edge regions of the putter head. In play, each player may assume a normal putting stance and use a normal putting stroke after addressing a ball in normal mode, with the single exception that one player swings from a normal right hand position and the other player must simultaneously swing from a normal left hand position. This gives a degree of awkwardness for a right hand player putting left-handed and for left-handed putter putting right handed. However, the game procedure for switching sides after each stroke equalizes any advantage or disadvantage. Additionally, the two shafts must be swung simultaneously and evenly if the putter head is to strike the ball at the correct normal angle for successful putt.

The only additional items used in this game, in addition to the putters required, are a ball, a target or cup, an actual or simulated green, and a scorecard.

BRIEF DESCRIPTION OF THE DRAWING

This invention may be more clearly understood from the following detailed description and by reference to the drawing, in which.

DETAILED DESCRIPTION OF THE INVENTION

Figure 1:
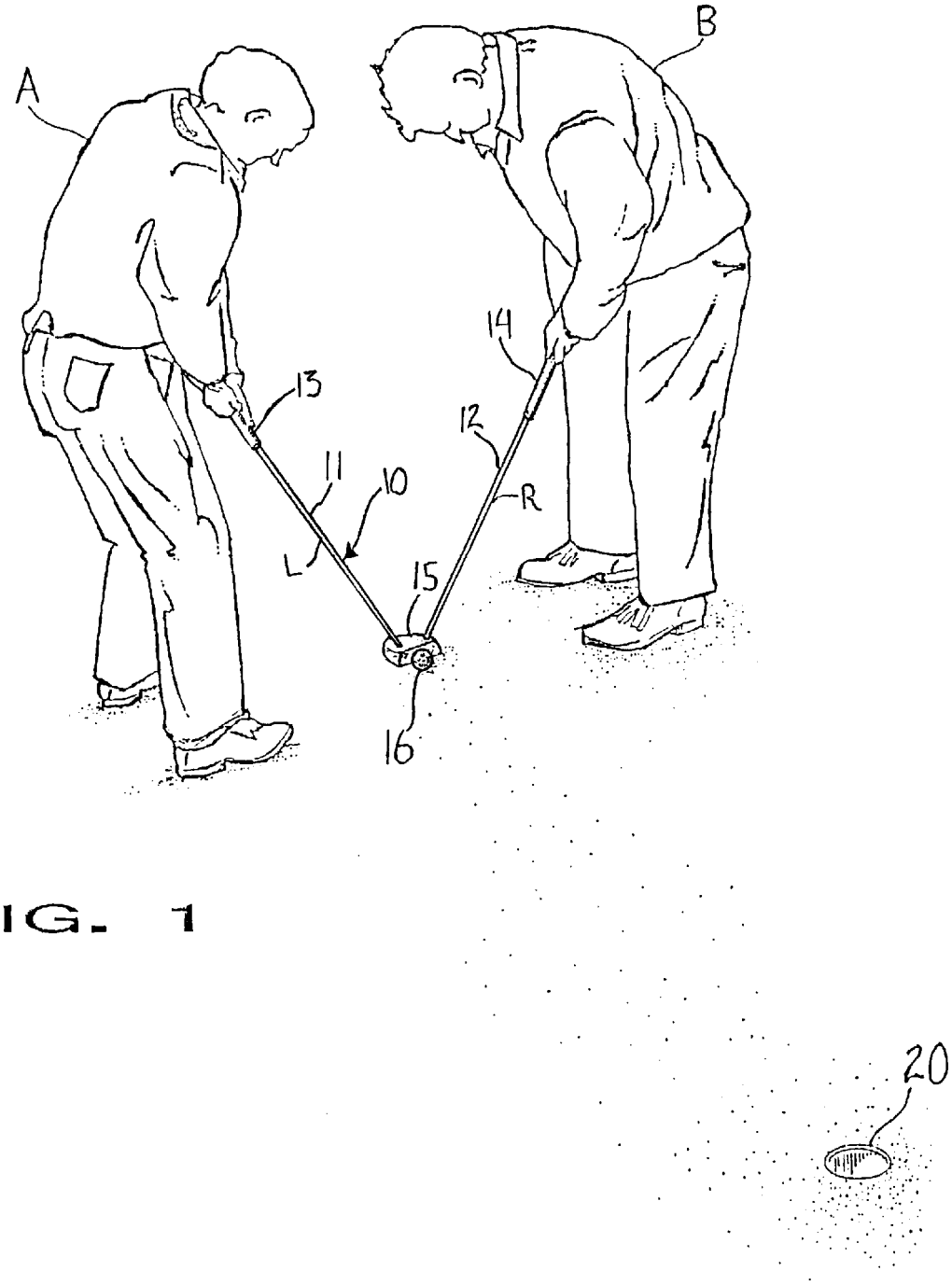
FIG. 1 is a perspective view of a two-person team employing a two-shafted putter, addressing a conventional golf ball putting towards a cup on a suitable putting green or substitute surface.

Now referring to the drawing, FIG. 1, in combination with FIGS. 2–6, a typical putting scene, in accordance with this invention, is shown with a pair of players constituting a two-player team of player A and player B. They are using a two-shafted golf putter of this invention, generally designated 10, having a pair of shafts 11 and 12, with its respective grip 13 and 14. The shafts 11 and 12 are secured at their lower end either through a hosel, or as shown in FIGS. 1–6, directly to a putter head 15. The head 15 may be of any normal putter configuration, including a flat ball striking face 1 SF. It is desirable that, with the exception of the second shaft, the shafts 11 and 12, grips 13 and 14, and head 15 have the appearance and feel of a conventional putter.

As shown in FIG. 1, the players each face each other, each grasp the grip portion 13 or 14 of their shaft 11 or 12 and address a conventional golf ball 16 for putting into a cup or target 20 in a green 0 or a simulated putting green surface.

The act of putting, simply stated, is accomplished by players A and B simultaneously swinging the club 10 to the rear, a distance appropriate for the distance to the cup or target 20 with the appropriate line for the green surface PG to accommodate its break, surface conditions, wind, and the other factors normally considered by a serious golfer in putting. The games or contests possible with this club 10 may be played on a single green of an established golf course, on a practice green with multiple holes, indoors on any suitable putting surface, including carpeting, or in a sheltered location where most of the various variable factors mentioned above are not present. In such a case, the advantage of seasoned golfers is further eliminated as a factor in winning.

After a few practice strokes without the ball 16, the players next in coordinated movement swing the putter 10 forward to strike the ball 16B and hopefully sink the putt in cup 20. If the players do not hole out in one stroke, in accordance with the rules of the various games or contests described below, the players A and B reverse sides after each stroke and continue putting. Player A, as shown in FIG. 1 using the left hand putter L shaft 11 and grip 13 shifts to use the right hand putter R shaft 12 and grip 14. His team partner next uses the left hand putter L for the next shot. It will be apparent after the first or second practice swing that one of the players needs to be the team captain and direct the team effort, a factor not heretofore present in the play of the game of golf.

After the first team A, B completes their turn; the next team C, D, then places the golf ball at the starting position used by the first team and attempts their luck and skill in this cooperative putting cycle.

The object of the club and the various games or contests is to entertain and provide team building as well as mild competition between several teams in a principally social environment.

Figure 2:
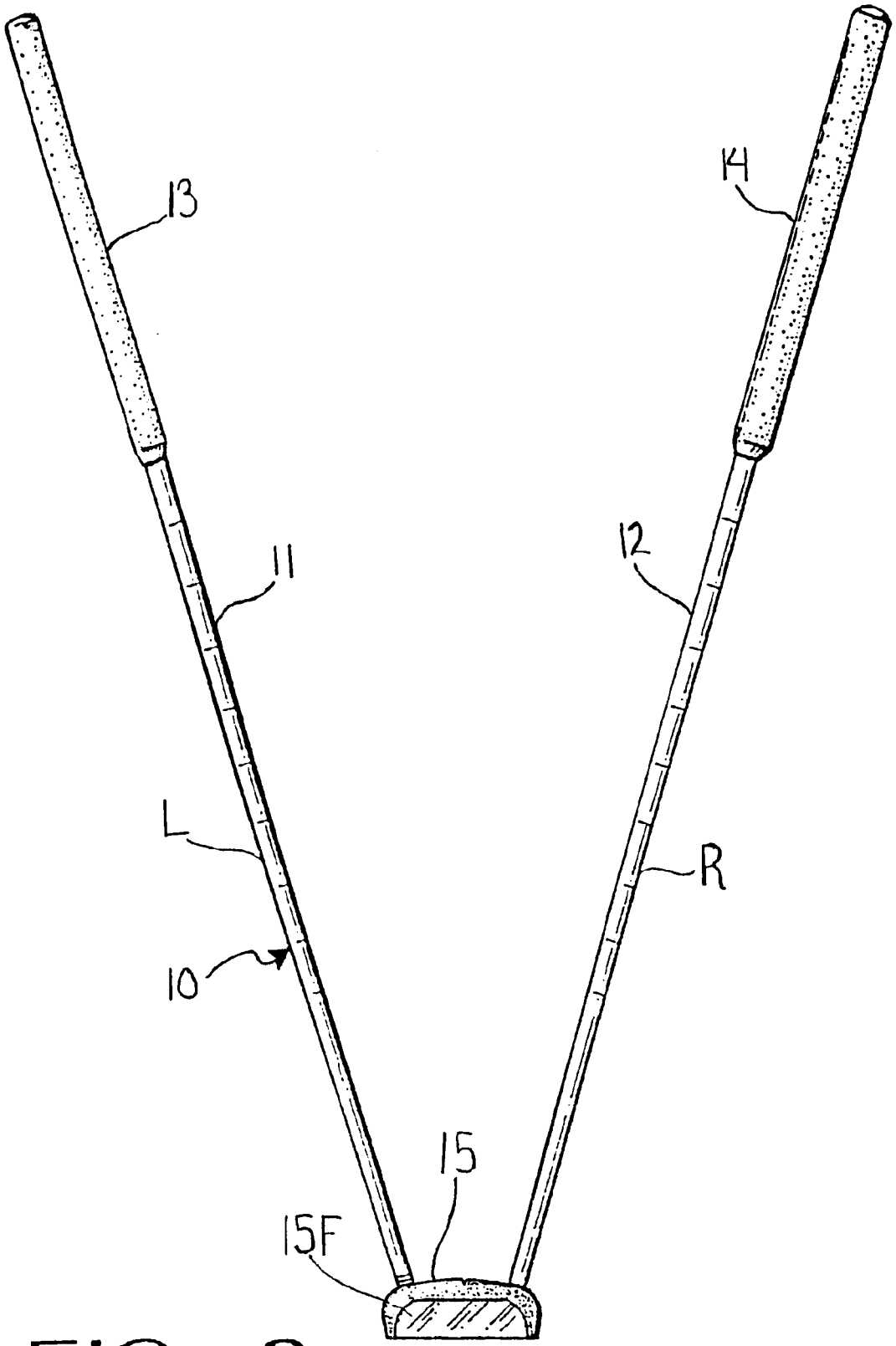
FIG. 2 is a front elevational view of the preferred form of putter for this invention.
Figure 4:
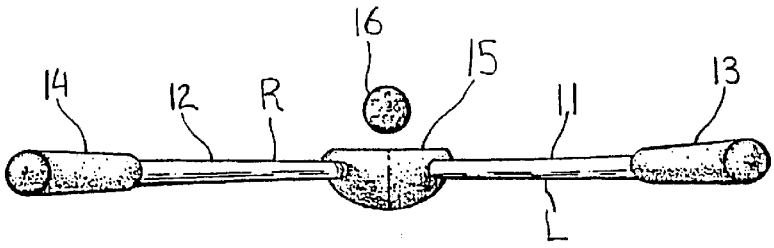
FIG. 4 is a top plan view of the preferred embodiment putter of this invention.
Figure 3:
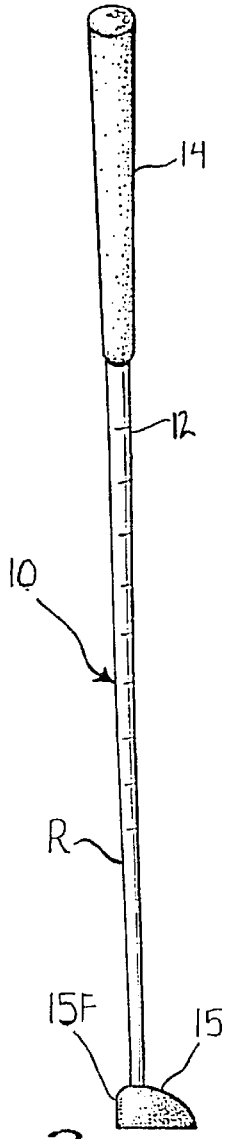
FIG. 3 is a side elevational view of the dual shaft putter of FIGS. 1 and 2.

The preferred form of club 10, which is shown in use in FIG. 1, namely a putter, may be better seen in FIGS. 2–6. The front elevational view of FIG. 2 shows the club as it might be viewed from the cup or target 20 in normal play. The front of striking surface 15F of the head 15 is the only part of the head that is visible. The two shafts 11 and 12 and their grips 13 and 14, which make up the rest of the club 10, are clearly visible angled outward at opposite angles in the order of 18 degrees, and generally lie in a plane parallel to the plane of the striking surface of the club head.

The lengths of the shafts may vary from a standard men's length, woman's standard length or youth's lengths for the expected mix of players. We have found that the greatest likelihood of players includes a male of 5 foot 10 inches in height to 6 feet 2 inches, and his partner may be a female between 5 foot 2 inches and 5 feet 6 inches. The shafts 11 and 12 for adult should be at least 33 inches in length from the club head to and including any hosel and the grips 13 and 14 are of sufficient length, namely between 33 to 35 inches in length to accommodate both player of such different heights with a comfortable grip.

For ease of storage and transport, one of the shafts, preferably shaft 11, is removable. A threaded connection between the left hand putter L shaft 11 and the head 15 makes this possible.

Figure 5:
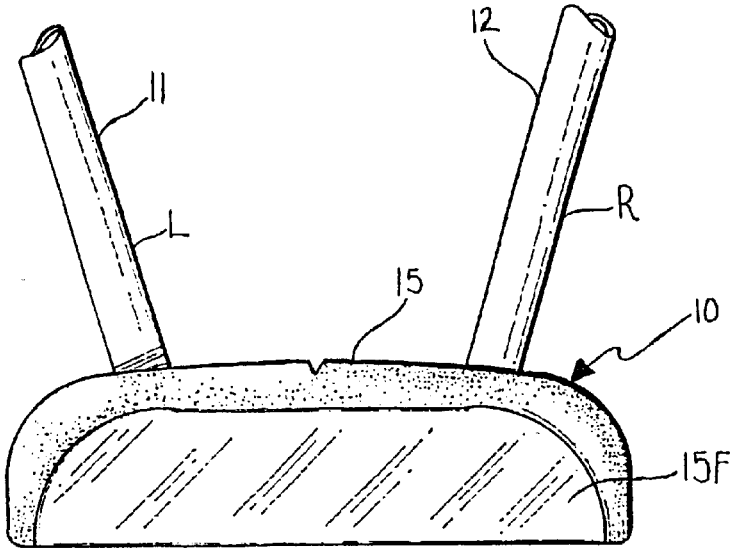
FIG. 5 is an enlarged front elevational view of the putter head of FIGS. 1–5 with the shafts partly broken away.
Figure 6:
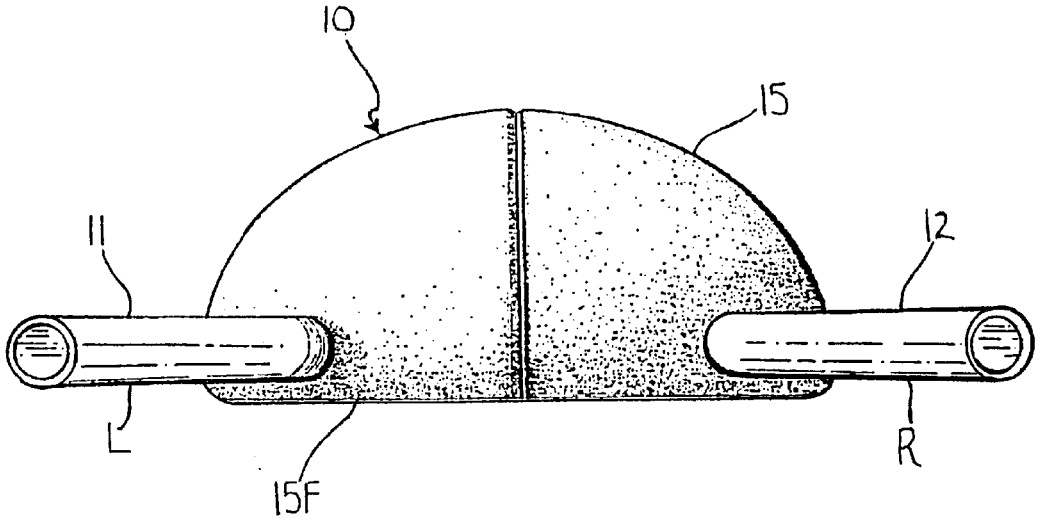
FIG. 6 is an enlarged top plan view of the putter head of FIGS. 1–5 similar in size to FIG. 5.

FIGS. 3–6 show the head 15 in more detail. As shown in FIGS. 5 and 6, head 15 may include a sight line common to many conventional putters extending from the center or "sweet spot" of the putter head rearward on the top surface of the head 15. In FIG. 6 such an optional sight line may be seen as a pair of lines 21 forming a slight V in the top surface of the putter head 15.

The Putting Contests

The putting contest format in accordance with this invention involves:

1. Two player teams with as many two player teams as desired.
2. In a round of play, each team is allowed two putts at each hole.
3. The first putt is from the standard starting distance, for example, 20 feet.
4. The second putt for each team may be a second try from
   a) the same starting position or
   b) from the stopping position of their first putt, depending upon the type of play, as described below.
5. After each putt, the members of a team switch sides of the putter for the next putt.
6. If only one team makes a putt, either on the first or second ball, they are the winner of the contest or, at least, that hole.
7. If more than one team makes their putt in the same number of strokes as the leading team, they will have a putt off. The contest is settled by sudden death putt off on a hole-by-hole basis.
8. If no team putts out in the first round, the starting position or the target are moved to a lesser distance, e.g., 15 feet.
9. If still no winner, the putting distance is next reduced to 10 feet and then to 5 feet until there is one winning team.

Stroke Play (by Total Score)

For stroke play of this invention;

1. Nine or eighteen holes are laid out or selected.
2. Foursomes or two player teams are selected.
3. Putting is commenced by each two-person team on each hole and each team scores its own putts for each hole.
4. All putts must be putted out.
5. The players switch sides of the putter after each putt.
6. The team with the lowest putting score, by strokes, of all teams playing, is the winning team.
7. In case of a tie, the leading teams have a sudden death playoff, hole by hole until one team wins the first hole. That team is declared the winner.

Match Play (by Holes)

1. The same as 1, above.
2. The same as 2, above.
3. The same as 3, above.
4. The same as 4, above.
5. The same as 5, above.
6. The team with the lowest score on any hole wins the hole.
7. The winning two-person team of the most holes is the contest winner.

Conclusion

For the first time a two-person variety of golf has in fact been developed. It is centered about a two-person golf club with both players constituting a team and a team, which must work together on each shot. The more skilled player may not be on the winning team if their efforts are not properly coordinated with their partner. Each player necessarily must play from their non-favored side, every other shot.

We have selected the putter and putting as the most feasible club to use, since it is difficult to predict the results of two persons simultaneously swinging a long iron or wood together. However, it is believed that players who have learned to play and enjoy two person putting, may, within the concept of this invention, apply these principles to other clubs than the putter with surprising and maybe exciting results. For that reason, this invention is believed not to be limited to putting.

The foregoing constitutes the best known embodiment of this invention. It is recognized that one of ordinary skill in the art of golf contests and golf clubs can conceive of variations on this invention, which do not depart from its spirit and concept. Therefore, this invention is not to be considered to be limited to the examples describe above and shown in the drawing, but rather to the invention as defined by the claims allowed in this application.

We claim:

1. A club comprising:

a head and a ball striking face;

a first shaft having an end connected to said head; and a second shaft having an end connected to said head;

wherein said first and second shafts are positioned in a plane generally parallel to said ball striking face; and said first and second shafts are angled upward and outward at opposite angles relative to each other such that said first shaft is oriented as a right-handed club and said second shaft is oriented as a left-handed club.

2. A club comprising:

a head and a ball striking face;

a first shaft having an end connected to said head; and a second shaft having an end connected to said head;

wherein said first and second shafts are positioned in a plane generally parallel to said ball striking face; and said first shaft and said second shafts are angled outwardly from the club head at opposite angles in the order of 18° from vertical.

3. A club comprising:

a head and a ball striking face;

a first shaft having an end connected to said head; and a second shaft having an end connected to said head;

wherein said first and second shafts are positioned in a plane generally parallel to said ball striking face;

wherein the first shaft has a gripping end opposite said head connected end and the second shaft has a gripping end opposite said head connected end; and said gripping ends are located for grasping by two different players for grasping a separate shaft, simultaneously swinging the club together.

4. A putter for use by two persons simultaneously in striking a ball, comprising:

a. a putter head having a body and a ball striking face;

b. a first shaft having a first end connected to said body of said putter head with a gripping end opposite said first end; and c. a second shaft having a first end connected to said body of said putter head with a gripping end opposite said first end;

wherein said first and second shafts are positioned in a plane generally parallel to said ball striking face and said first and second shafts are angled upward and outward relative to each other such that said first shaft when held by a player in a position to strike the ball is oriented for use by one player as a right-handed club and said second shaft when held by a player in a position to strike the ball is oriented for use by a second player as a left handed club simultaneously.

5. A putter in accordance with claim 4 herein said putter head is rigidly secured to the connected end of said first shaft, and said second shaft is removably connected to the connection end and the putter head is adapted to receive and rigidly hold the connected end of said second shaft.

6. A putter in accordance with claim 4 wherein the length of said first shaft is substantially equal to the length of said second shaft.

7. A putter in accordance with claim 4 wherein said first shaft and said second shafts are angled outwardly from the putter head at opposite angles in the order of 18° from vertical.

8. A putter in accordance with claim 4 wherein the length of said first shaft and the length of said second shaft are between 33 and 35 inches measured from the putter head to the gripping end of the shaft.

* * * * *

UNITED STATES PATENT AND TRADEMARK OFFICE
Certificate

Patent No. 6,277,031 B1 Patented: August 21, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Scott D. Cameron, Carlsbad, CA.

Signed and Sealed this Sixteenth Day of April 2002.

PAUL T. SEWELL
*Supervisory Patent Examiner*
Art Unit 3711

UNITED STATES PATENT AND TRADEMARK OFFICE

CERTIFICATE OF CORRECTION

PATENT NO. : 6,277,031 B1
DATED : August 21, 2001
INVENTOR(S) : Scott D. Cameron It is certified that error appears in the above-identified patent and that said Letters Patent is hereby corrected as shown below:

Title page,
Item [54], Title, please amend the title to read as follows: -- TWO PLAYER GOLF CLUB --

Signed and Sealed this

Twenty-second Day of October, 2002

*Attest:*

*Attesting Officer*

JAMES E. ROGAN
*Director of the United States Patent and Trademark Office*